US005515553A

United States Patent [19]

Charriere et al.

[11] Patent Number: 5,515,553

[45] Date of Patent: May 14, 1996

[54] TOILET TANK FLUSH CONTROL SYSTEM

[75] Inventors: Lucien L. Charriere; Aldo Cipolla; Mario Tuzi, all of Winnipeg, Canada

[73] Assignee: M.A.L. Enterprises Ltd., Winnipeg, Canada

[21] Appl. No.: 352,704

[22] Filed: Dec. 5, 1994

[51] Int. Cl.[6] ..... E03D 1/14

[52] U.S. Cl. ..... 4/325; 4/415

[58] Field of Search ..... 4/324, 325, 378, 4/392, 393, 401, 415

[56] References Cited

U.S. PATENT DOCUMENTS 2,835,900 5/1958 Gleason ..... 4/324

3,996,629 12/1976 Riedel ..... 4/324

*Primary Examiner*—Charles E. Phillips

*Attorney, Agent, or Firm*—Adrian D. Battison; Murray E. Thrift

[57] ABSTRACT

An improved toilet tank flush control system provides a spring member which engages a rear surface of the flap control valve of the tank to apply a pressure to the flap tending to close it, which allows the user to control the amount of water discharged in the flushing action from a minimum up to the full quantity within the tank. Two alternative embodiments of the flush control mechanism are described herein, the first being for use with American standard type toilets in which the spring is mounted on a bracket fastened to the base of the tank and stands upwardly therefrom at an angle of the order of 45 degrees to engage a base surface of the float control of the flap valve, and the second being for use with a Crane type toilets in which the spring is mounted on the overflow duct and faces downwardly to engage an upper surface of the flap valve as it pivots upwardly.

10 Claims, 4 Drawing Sheets

TOILET TANK FLUSH CONTROL SYSTEM

This invention relates to a toilet tank of the type including a container in the form of a hollow tank for receiving a quantity of flushing water for discharge into the toilet, an opening at the base of the tank for release of the flushing water from the tank into the toilet and a stopper member engageable with the opening for holding the opening closed, the stopper member being moveable in response to manual operation of a lever to release the water in a flushing action.

BACKGROUND OF THE INVENTION

Conventionally, the stopper member is shaped so that, when it is lifted it is moved to a fully raised position and remains in that position by its cooperation with the water in the tank until all of the water is discharged where upon a stopper member is moved by gravity back to the closed position.

This cooperation has conventionally been used to ensure that a full quantity of the flushing water is discharged to ensure a proper flushing action. This design was generated at a time when concern for the water supply was at a minimum so that a full discharge was much preferred at each flush with the concentration being on ensuring a proper flushing action rather than minimizing the quantity of water used. Toilets of this design are therefore in wide use in large numbers in homes throughout North America.

Attempts have been made to reduce that quantity of water released in the flushing action by providing weights which rest against the stopper member to provide an increased downward force on the stopper member so that it returns to the closed position before the level of the water drops to the normal minimum position. In one example a weight is engaged over the stopper member and remains in position on the stopper member to move the center of gravity of the stopper member. This arrangement is proposed generally for use with the style of flushing action manufactured by American Standard.

In an alternative arrangement in which the toilet includes a vertical over flow pipe, a sliding weight is provided which runs up and down the vertical pipe and is arranged to fall and hit the stopper flap when the water level falls to a lower position.

None of these weight type devices allows the user to effectively control the amount of water flushed since the stopper member moves by the lever action to its normal fully open position allowing the discharge of water and then is moved to the closed position after discharge of a smaller quantity of water than is normally discharged. The user cannot therefore easily control the amount of flushing water from a very small quantity for a small flush or up to the maximum quantity for a larger flush if required in a particular circumstance.

SUMMARY OF THE INVENTION

One object of the present invention, therefore, is to provide an improved toilet tank flushing control system which allows the user to control the amount of water discharged in the flushing action from a minimum up to the full quantity within the tank.

According to the invention, therefore, there is provided a flush water supply tank for a toilet comprising a hollow tank for receiving a quantity of flushing water for discharge into the toilet, a opening at the base of the tank for release of flushing water from the tank into the toilet, a stopper member having a stop surface engageable into the opening for holding the opening closed in a closed position of the stopper member, means mounting the stopper member for pivotal movement from the closed position into an open position for release of the water, the stopper member being shaped and arranged such that it is held in the closed position by pressure of the flushing water resting of the stopper, a lever for lifting the stopper member having a handle exteriorly of the tank for manual operation, and spring means mounted in the tank arranged to engage a surface of the stopper member to apply a spring force on the stopper member tending to move it to the closed position.

DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
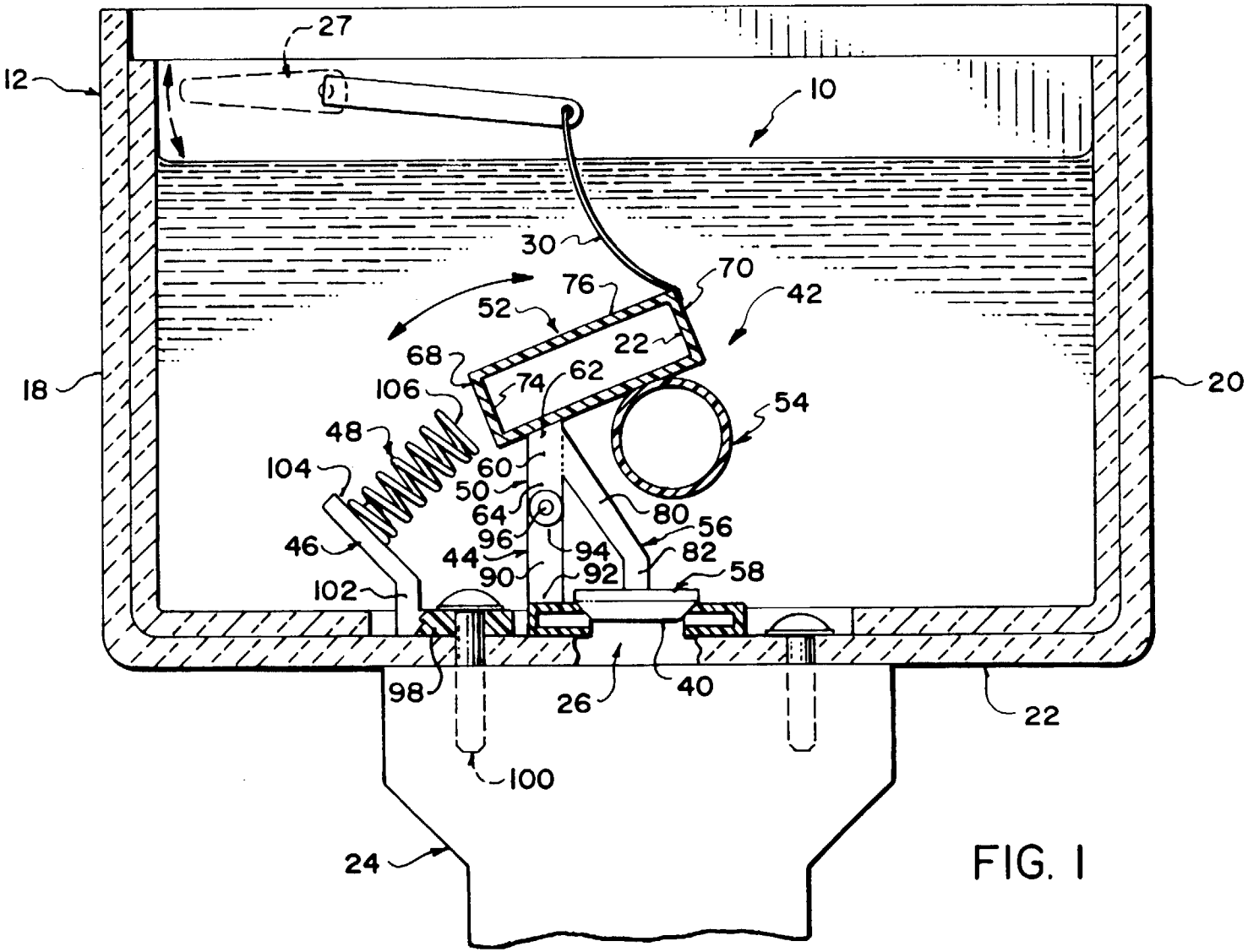
FIG. 1 is a rear cross sectional view of an American Standard type flush control mechanism.

Referring to the accompanying figures the toilet tank flush control system is shown generally at 10. The toilet tank flush control system 10 includes a hollow tank body 12, with a front side 14, rear side 16, left side 18, right side 20, and a base 22. The base 22 is connected to the top of a toilet 24, and has an opening 26 in it to convey water to the toilet 24 for flushing.

The toilet tank 12 has a lever mechanism 27 mounted on it to actuate the stopper member 42. The stopper member 42 is located within the tank body 12 and is connected to the lever mechanism 27 by an elongate flexible link 30, usually a chain or cable. The stopper member 42 has a stop surface 40 which engages the opening 26 in the base 22 when in the closed position. When the lever mechanism 27 is operated it actuates the stopper member 42 moving it into the open position. Once the open position the stop surface 40 of the flush control mechanism 28 is spaced from the opening allowing water to flow therethrough.

Two alternative embodiments of the flush control mechanism are described herein, the first being for use with American standard type toilets and the like, the second being for use with a Crane type toilets and the like.

Figure 2:
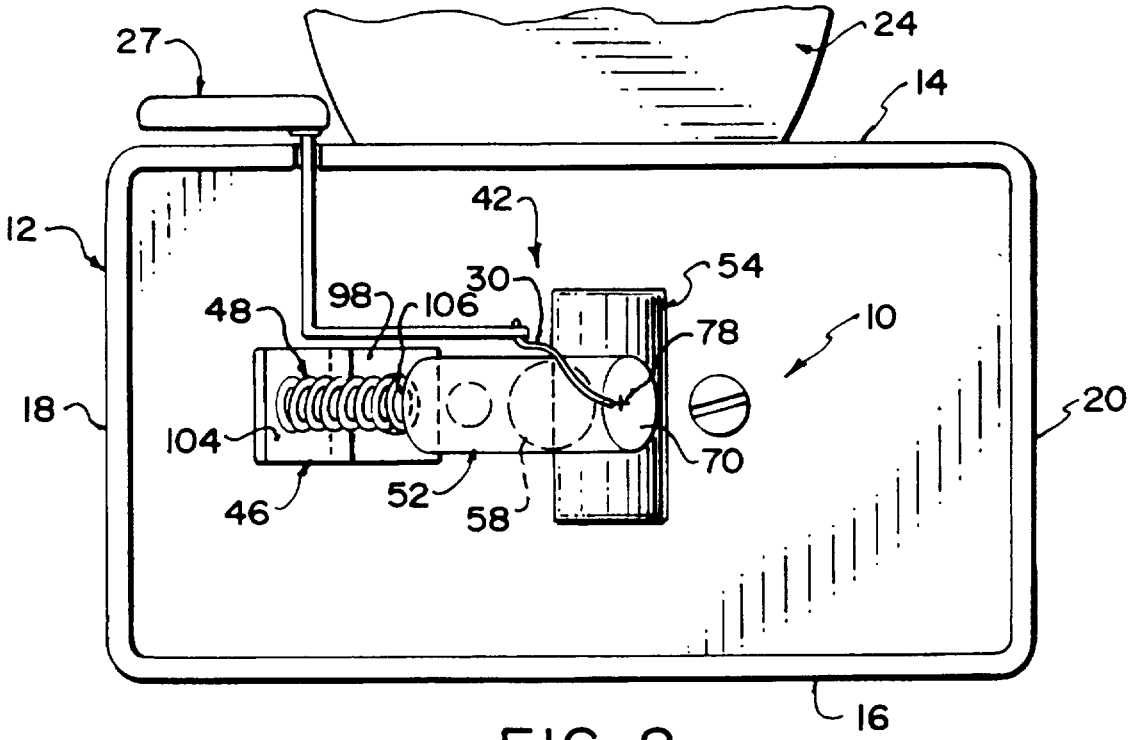
FIG. 2 is a top view of an American Standard type flush control mechanism.

In the American standard type embodiment the flush control mechanism shown in FIGS. 1 and 2 comprises a stopper member 42, mounting means 44, a bracket 46, and a spring 48.

The stopper member 42 includes a support member 50, a cylindrical body 52, a counter weight/drag member 54, a stopper support arm 56, and a stopper 58. The stopper member 42 is shaped such that, with the spring 48 removed, and with the stopper member 42 lifted, the stopper member tends to pivot to an open position for release of a quantity of water. The stopper member 42 remains in the open position until the quantity of water is discharged and then returns to the closed position only after the quantity of water is fully discharged.

The support member 50 comprises a generally vertical column 60 which is fixed to the mounting means 44 at its bottom 62 and to the cylindrical body 52 at its top 64.

The cylindrical body 52 is part of a float control portion of the stopper member 42 and is fixed a point on its underside near to and spaced from its lower end 68 to the support member 50, and fixed to the elongate flexible link 30 at its upper end 70. The cylindrical body 52 at an angle to the support member 50 inclined upwards and towards a side wall of the tank. At each of the upper 70 and lower 68 ends of the cylindrical body 52 there is an end wall 72 and 74 oriented at right angles to the longitudinal axis of the cylindrical body 52. The cylindrical body 52 has a cylindrical surface 76 surrounding the longitudinal axis.

The cylindrical counter weight/drag member 54 is a cylindrical member fixed to the cylindrical body 52 at a point near to and spaced from the cylindrical body's upper end 70. The cylindrical counter weight/drag member 54 is fixed at a point near its center 78 with its longitudinal axis perpendicular to that of the cylindrical body 52. When the flush control mechanism 28 is in the open position the counter weight/drag member 54 biases the stopper member 42 into the closed position and causes the stopper member to close slowly.

The stopper support arm 56 extends out from a point near the upper end 62 of the support member 42. The stopper support 56 has a upper member 80 which angles downwards from the support member 50 and a lower member 82 which projects vertically downwards from the bottom end of the upper member. At the bottom end of the lower member 82 is fixed the stopper.

The stopper 58 is fixed to the bottom end of the stopper support arm 56. On the bottom side of the stopper 56 is a stop surface 40. The stopper 56 and stop surface 40 are located in a position over the opening 26 in the base 22 of the tank such that when the stopper member 42 is in its closed position the stop surface engages the opening 26 holding the opening closed.

The mounting means 44 comprises a vertical column 90 fixed at its bottom end 92 to the base 22 of the tank and fixed at its top end 94 by means of a pivot connection 96 to the support member 50 such that the support member 50 and thereby the entire stopper member 42 can pivot about the pivot connection.

The bracket 46 comprises a horizontal base tab 98 lying flat on the base 22 of the tank and is held in contact with the base by a screw 100 engaging through the base 22 into the toilet. A member 102 projects vertically upwards from one end of the horizontal base tab 98 then angles upwards at an incline defining a bracket surface 104. The bracket surface 104 lies in a plane which is substantially parallel to the end wall 72 of the cylindrical body when the end wall 72 is moved to a position engaging the end 106 of the spring 48.

The spring 48 is mounted on the bracket 46 extending outwards at right angles to the bracket surface 104. The spring 48 comprises a coil spring arranged such that its longitudinal axis lies substantially along the direction of movement of the cylindrical body of the stopper member. When the stopper member 42 is in the closed position the upper end 106 of the coil spring 48 is spaced away from the lower end wall 72 of the cylindrical body 52. When the stopper member is in the open position the upper end 106 of the coil spring comes in contact with the lower end wall 72 of the cylindrical body 52 compressing the spring and applying a force biasing the stopper member into the closed position.

Figure 4:
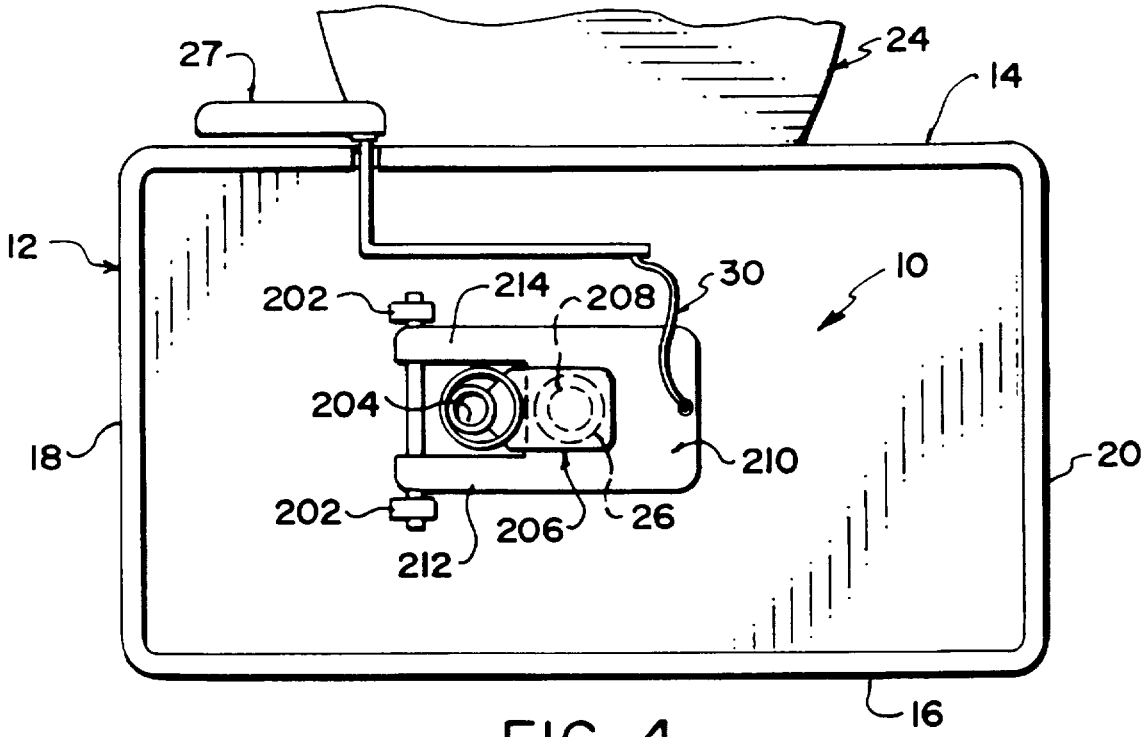
FIG. 4 is a top view of an Crane type flush control mechanism.
Figure 3:
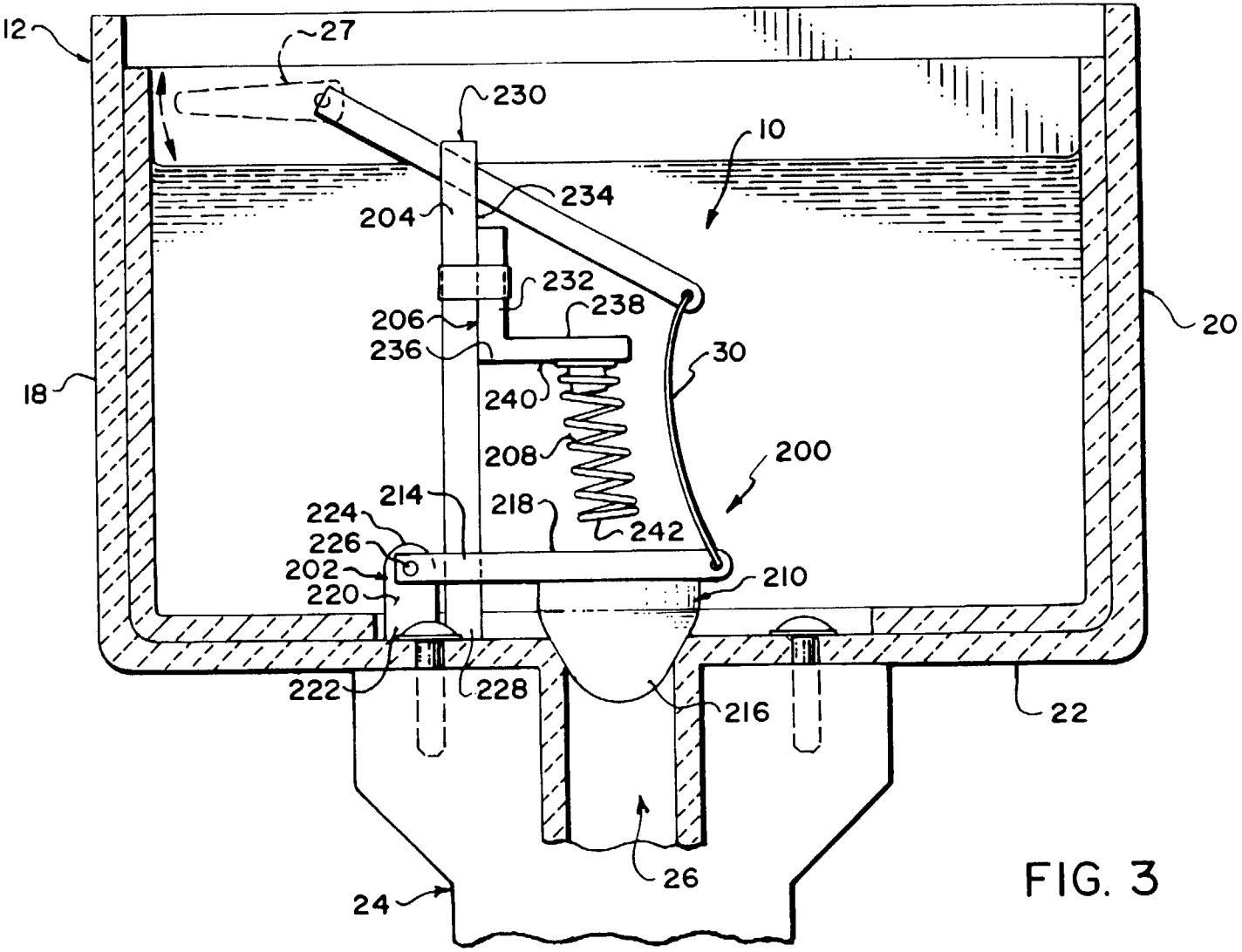
FIG. 3 is a rear cross sectional view of an Crane type flush control mechanism.

In the alternative embodiment the flush control mechanism for the Crane type toilet is shown in FIGS. 3 and 4, comprising a stopper member 200, mounting means 202, a water overflow pipe 204, a bracket 206, and a spring 208.

The stopper member 200 includes a stopper 210, and stopper support arms 212 and 214, and is shaped such that, with the spring 208 removed, and with the stopper member 200 lifted, the stopper member 200 tends to pivot to an open position for release of a quantity of water and to remain in the open position until the quantity of water is discharged and to return to the closed position only after the quantity of water is fully discharged.

The stopper 210 is fixed at one end to the elongate flexible link 30 and at the other to the stopper support arms 21 2 and 214. The stopper 210 is located in a position over the opening 26 in the base 22 of the tank. On the side of the stopper 210 facing the base 22 of the tank is located a stop surface 216. On the side of the stopper opposite the base 22 of the tank is a horizontal rear surface 218 facing substantially upwardly away from and opposite to the stop surface 216. When the stopper member 200 is in its closed position the stop surface 216 engages the opening 26 holding the opening closed.

The stopper support arms 212 and 214 project outwards from the end of the stopper 210 opposite the end linked to the elongate flexible link 30. The arms 212 and 214 are arranged parallel to one another and are spaced apart such that they straddle the water overflow pipe 204.

The mounting means 202 comprise a vertical column 220 fixed at its bottom end 222 to the base 22 of the tank and fixed at its top end 224 by means of a pivot connection 226 to the stopper support arms 212 and 214 such that the stopper support arms 212 and 214 and thereby the stopper 210 can pivot about the pivot connection 226.

The water overflow tube 204 is mounted on and is fixed to the base 22 at its bottom end 228 and extends vertically upwards from the base to a free top end 230. The water overflow tube 204 lies between the mounting means 202 and the opening 26 in the base 22 of the tank.

The bracket 206 includes a vertical member 232 which is fixed to the surface 234 of the water overflow pipe 204 nearest the opening 26 in the base. Projecting outwardly from the bottom end 236 of the vertical member 234 is a horizontal member 238. The horizontal member 238 includes a downwardly facing surface 240 which projects over and is a distance above the stopper 210 and the opening 26 in the base.

The spring 208 comprises a coil spring mounted on the downwardly facing surface 240 of the bracket 206. The spring 208 is fixed at right angles to the surface of the bracket 206 and extends vertically downwards for engagement with the rear surface 218 of the stopper member 200. The longitudinal axis of the spring is substantially along the direction of movement of the stopper member 200. When the stopper member 200 is in the closed position the spring 208 is spaced away from the rear surface 218 with its lower end 242 spaced upwardly away from the rear surface 218 of the stopper member 200. When the stopper member 200 is in the open position the lower end 242 of the coil spring 208 comes in contact with the rear surface 218 of the stopper member 200 compressing the spring 208 and applying a force biasing the stopper member 200 into the closed position.

Figure 6:
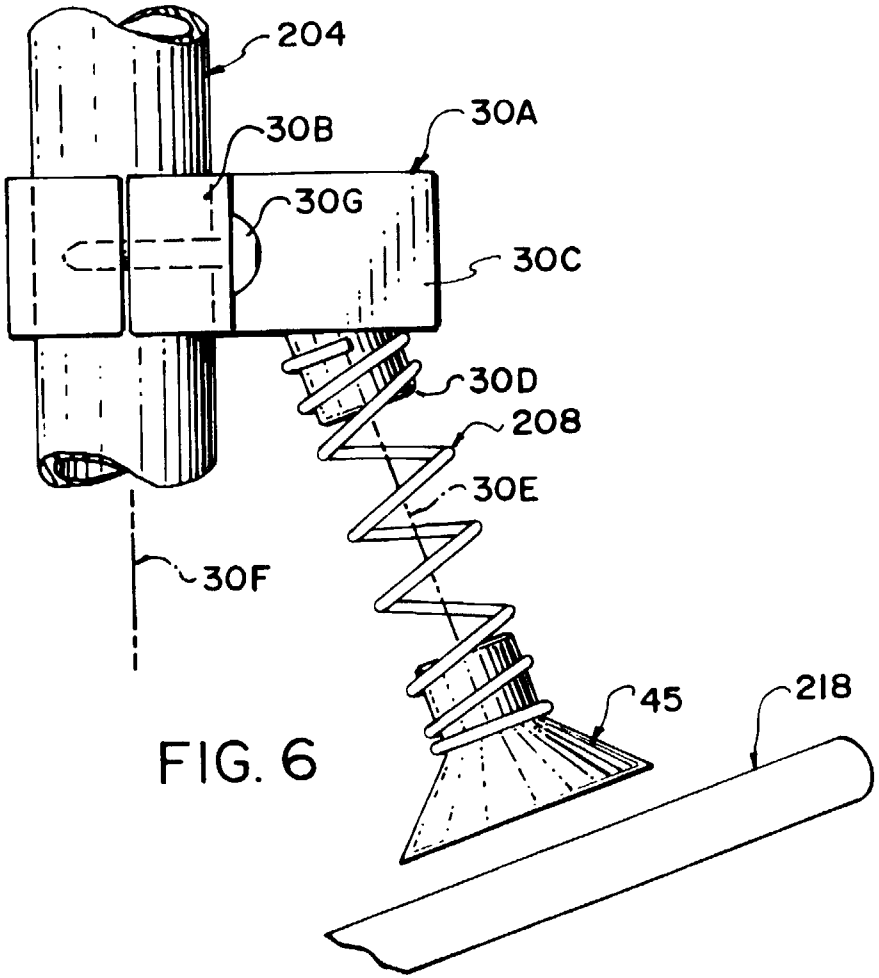
FIG. 6 is a side elevational view of an alternative arrangement for mounting the spring in the embodiment of FIGS. 3 and 4.
Figure 5:
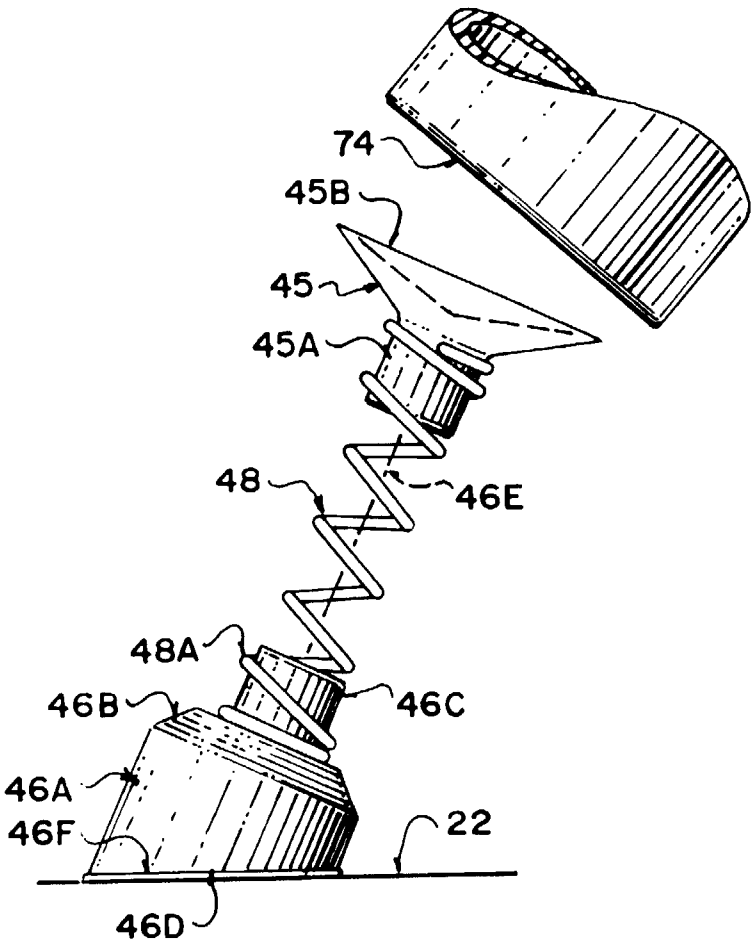
FIG. 5 is a side elevational view of an alternative arrangement for mounting the spring in the embodiment of FIGS. 1 and 2.

Turning now to FIGS. 5 and 6 there are shown alternative arrangements for use respectively with the arrangement of FIGS. 1 and 2 and the arrangement of FIGS. 3 and 4.

Thus turning firstly to FIG. 5, the bracket 46 is replaced by a bracket 46A in the form of a generally cylindrical body which is chamfered at its upper end as indicated at 46B and converges down to a second cylindrical portion 46C on which an end 48A of the spring 48 is received as a friction fit. An end face of the cylindrical body is cut at an angle as indicated at 46D so that the longitudinal axis of the spring as indicated at 46E which is co-axial with the axis of the cylindrical body lies at an angle to the base 22 of the tank. The flat bottom surface 46D of the cylindrical body is attached to the base 22 by a layer of adhesive 46F.

At the opposed end of the spring is mounted an abutment member 45 having a cylindrical portion 45A received as a friction fit within the end of the spring 48. The abutment member diverges outwardly from the upper end of the cylindrical member 45A to form a conical portion having an end face 45B for engaging the end of the float of the stopper member as indicated at 74. The abutment member thus provides a circular surface 45B for engaging the end 74 of the stopper so that there is a tendency for the abutment to twist slightly to follow or lie flat against the end surface 74 thus slightly bending the spring so that the spring is more controlled in its action.

Turning now to FIG. 6, there is shown an alternative arrangement for the structure shown in FIGS. 3 and 4. In particular there is provided a bracket 30A in the form of collar 30B which is clamped around the tube 204. One part of the collar projects outwardly from the tube 204 and forms a support 30C for the spring 208. An end of the spring is engaged onto a cylindrical portion 30D attached to an underside of the support 30C at an angle thereto so that an axis of the spring as indicated at 30E is arranged at an angle to the vertical and at an angle to the vertical axis of the tube 204 as indicated at 30F. An abutment member 45 identical to the abutment as shown in FIG. 5 is mounted on the other end of the spring for engaging the rear surface 218 of the stopper.

The collar 30B is clamped in place by a screw 30G thus locating the mounting portion 30C at a required height. The mounting of the spring at the angle of the axis 30E presents the abutment member and particularly the front surface thereof to the back surface of the stopper at an angle to the vertical and to the horizontal so that the surface of the stopper engages the abutment member after a short distance of movement of the stopper. The angle of the front face of the abutment member is generally midway between the initial contact angle of the rear surface of the stopper and the final angle of the stopper after it is pulled more vigorously upwardly against the pressure of the spring. The front face of the abutment member thus tends to follow the surface of the stopper and slightly twists the spring so that the spring is prevented from distortion and is better controlled in its movement.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A flush water supply tank for a toilet comprising a hollow tank having a horizontal base wall and a plurality of upstanding side walls for receiving a quantity of flushing water for discharge into the toilet, a opening in the base wall of the tank for release of flushing water from the tank into the toilet, a stopper member having a stop surface engageable into the opening for holding the opening closed in a closed position of the stopper member, means mounting the stopper member for pivotal movement about an axis parallel to the base wall from the closed position into an open position for release of the water, the stopper member being shaped and arranged such that it is held in the closed position by pressure of the flushing water resting of the stopper, a lever for lifting the stopper member having a handle exteriorly of the tank for manual operation, and spring means mounted in the tank arranged to engage a surface of the stopper member to apply a spring force on the stopper member tending to move it to the closed position, said spring means including a mounting member mounted at a fixed position in the tank, a helical coil spring having a longitudinal axis, means fixing the coil spring by one end only of the coil spring on the mounting member so that a remaining portion and an opposed free end of the coil spring are axially spaced from the mounting member and project axially therefrom for transverse movement relative thereto, and an abutment member attached to and carried by the opposed free end and defining an abutment surface generally at right angles to the axis of the spring, the mounting member and the abutment member being separate from the stopper member for movement relative thereto.

2. The tank according to claim 1 wherein the opposed free end of the coil spring is arranged such that it is spaced away from the surface of the stopper member when the stopper member is in a closed position.

3. The tank according to claim 1 wherein the stopper member includes a cylindrical body forming a float control portion of the stopper member, the cylindrical body having a cylindrical surface surrounding an axis which is inclined upwardly and toward one side wall of the tank and the cylindrical body having an end wall at right angles to the axis and wherein the mounting member is attached to the base wall of the tank, the mounting member having a spring mounting surface extending in an inclined direction upwardly and toward one side wall, the coil spring being mounted on the spring mounting surface with the axis thereof extending at right angles thereto.

4. The tank according to claim 3 wherein the mounting member includes a flat base bonded by an adhesive to the base wall of the tank.

5. The tank according to claim 3 wherein the coil spring has an end thereof spaced away from the end wall of the cylindrical body when the stopper is in the closed position.

6. The tank according to claim 3 wherein the spring mounting surface is arranged to be substantially parallel to the end wall of the cylindrical body when the end wall is moved to a position engaging the end of the spring.

7. The tank according to claim 3 wherein the mounting member comprises a base tab lying flat on the base wall of the tank and held in contact therewith by a screw engaging through the base wall into the toilet.

8. The tank according to claim 3 wherein the mounting member has a cylindrical portion receiving the end of the spring wrapped therearound and wherein the spring carries at an end thereof for engaging the stopper member an abutment member having a cylindrical portion receiving the end of the spring wrapped therearound.

9. A flush water supply tank for a toilet comprising a hollow tank having a horizontal base wall and a plurality of upstanding side walls for receiving a quantity of flushing water for discharge into the toilet;

a opening in the base wall of the tank for release of flushing water from the tank into the toilet;

a stopper member having a stop surface engageable into the opening for holding the opening closed in a closed position of the stopper member;

means mounting the stopper member for pivotal movement about an axis parallel to the base wall from the closed position into an open position for release of the water;

the stopper member being shaped and arranged such that it is held in the closed position by pressure of the flushing water resting of the stopper;

a lever for lifting the stopper member having a handle exteriorly of the tank for manual operation;

and spring means mounted in the tank arranged to engage a surface of the stopper member to apply a spring force on the stopper member tending to move it to the closed position;

said spring means including a mounting member having a cylindrical projecting portion, said means being mounted at a fixed position in the tank, a helical coil spring having a longitudinal axis, said cylindrical projecting portion of the mounting member extending coaxially into one end only of the coil spring so that said one end is fixed to the projecting portion and so that a remaining portion and an opposed end of the coil spring are axially spaced from the mounting member and project axially therefrom for transverse movement relative to said mounting member, the axis of the projecting portion and the spring being arranged at an angle which is inclined relative to the base wall and relative to a line normal thereto, the mounting member being separate from the stopper member for movement relative thereto.

10. A flush water supply tank for a toilet comprising a hollow tank having a horizontal base wall and a plurality of upstanding side walls for receiving a quantity of flushing water for discharge into the toilet;

a opening in the base wall of the tank for release of flushing water from the tank into the toilet;

a stopper member having a stop surface engageable into the opening for holding the opening closed in a closed position of the stopper member;

means mounting the stopper member for pivotal movement about an axis parallel to the base wall from the closed position into an open position for release of the water;

the stopper member being shaped and arranged such that it is held in the closed position by pressure of the flushing water resting on the stopper;

a lever for lifting the stopper member having a handle exteriorly of the tank for manual operation;

and spring means mounted in the tank arranged to engage a surface of the stopper member to apply a spring force on the stopper member tending to move it to the closed position;

said spring means including a mounting member having a cylindrical projecting portion, said means being mounted at a fixed position in the tank, a helical coil spring having a longitudinal axis, said cylindrical projecting portion of the mounting member extending coaxially into one end only of the coil spring so that said one end is fixed to the projecting portion and so that a remaining portion and an opposed end of the coil spring are free from and separate from the mounting member and project outwardly therefrom for movement relative to said mounting member, the axis of the projecting portion and the coil spring being arranged at an angle which is inclined relative to the base wall and relative to a line normal thereto and an abutment member attached to and carried by the opposed free end and defining an abutment surface generally at right angles to the axis of the spring, the mounting member and the abutment member being separate from the stopper member for movement relative thereto.

* * * * *